US005319945A

United States Patent [19]

Bartlett

[11] Patent Number: 5,319,945

[45] Date of Patent: Jun. 14, 1994

[54] METHOD AND APPARATUS FOR NON-ATMOSPHERIC VENTING OF EVAPORATOR OVER-PRESSURE IN A REFRIGERATION SYSTEM

[75] Inventor: David W. Bartlett, La Crosse, Wis.

[73] Assignee: American Standard Inc., New York, N.Y.

[21] Appl. No.: 906,253

[22] Filed: Jun. 29, 1992

[51] Int. Cl.[5] ..... F25B 41/00

[52] U.S. Cl. ..... 62/174; 62/324.4

[58] Field of Search ..... 62/174, 324.4

[56] References Cited

U.S. PATENT DOCUMENTS

| | | | |
|---|---|---|---|
| 3,238,737 | 3/1966 | Shrader et al. | 62/174 |
| 4,096,706 | 6/1978 | Beckwith | 62/174 X |
| 4,223,537 | 9/1980 | Sanborn et al. | 62/174 |
| 4,332,136 | 6/1982 | Quack | 62/54 |
| 4,637,219 | 1/1987 | Grose | 62/199 |
| 4,864,829 | 9/1989 | Manning et al. | 62/85 |

*Primary Examiner*—William E. Wayner
*Attorney, Agent, or Firm*—William J. Beres; William O'Driscoll; Peter D. Ferguson

[57] ABSTRACT

An over-pressure control apparatus for a refrigeration system provides for non-atmospheric venting of an evaporator during over-pressure conditions. The control apparatus includes a sensor for indicating evaporator pressure, a storage vessel for receiving liquid refrigerant from the evaporator, and a controller responsive to the sensor. The controller acts in response to the reading of the sensor to selectively open and close at least one control valve coupling the storage vessel to the evaporator and condenser of the refrigeration system. Liquid refrigerant is vented from the evaporator to the storage vessel in response to a detected over-pressure condition.

The over-pressure control method hereof acts to vent liquid refrigerant from the evaporator at a predetermined pressure above normal operating pressure, but below the pressure where emergency venting of refrigerant vapor from the evaporator to the atmosphere is required. The liquid refrigerant vented from the evaporator can be returned from the storage vessel to the refrigeration system after the evaporator is restored to normal operating pressure.

15 Claims, 1 Drawing Sheet

METHOD AND APPARATUS FOR NON-ATMOSPHERIC VENTING OF EVAPORATOR OVER-PRESSURE IN A REFRIGERATION SYSTEM

TECHNICAL FIELD

This invention pertains generally to a method and apparatus for controlling over-pressure conditions in the evaporator component of a refrigeration system. In particular, it relates to a system for relieving over-pressure conditions within a refrigerant evaporator without releasing refrigerant to the atmosphere.

BACKGROUND ART

The cooling effect in typical refrigeration systems is provided by the vaporization of liquid refrigerant in the cooling coils of a sealed evaporator. Comparatively large quantities of heat are absorbed as the liquid refrigerant is evaporated into vapor, and water or air can be cooled as it is passed over cooling coils that contain the evaporating refrigerant. Alternatively, refrigerant can be flooded into an evaporator that includes internal tubes through which water flows to be cooled. In either case, the refrigerant vapor is drawn from the evaporator by suction to a compressor, which increases the pressure and temperature of the vapor. The vapor is then pumped to a condenser where the latent heat of the pressurized vapor is removed, typically to the ambient air, condensing the refrigerant vapor back into a liquid. The condensed, pressurized liquid refrigerant is reintroduced into the evaporator through an expansion or metering device that reduces the pressure of the liquid refrigerant. The low pressure cold liquid refrigerant is again vaporized in the evaporator, and the above described cycle is repeated.

The pressure within a refrigeration system evaporator can reach unacceptably high values under a number of abnormal operating conditions. For example, chilled water systems pass water through evaporator cooling coils, and the chilled water is circulated to areas remote from the coils. For a variety of reasons, the refrigeration system and the water circulation system are often designed as separate systems. Through operating error, the refrigeration system can be shut down, but the water circulating pump left on. As the structure or system warms (because the refrigeration system is shut down), the temperature of the circulating water rises, causing warming within the evaporator and refrigerant evaporation, which in turn raises the pressure in the evaporator.

Leaking isolation valves on two pipe heating and cooling systems are another common source of evaporator over-pressure conditions. Two pipe heating and cooling systems use the same water and water circulation piping to both heat and cool a building. When the heating season arrives, isolation valves are closed, directing the circulated water from the refrigeration system to the heating system. Heated water can be inadvertently introduced into the refrigeration system evaporator if the isolation valves fail to properly close. The heated water (typically at about 180° F.) will cause rapid vaporization of coolant within the evaporator, resulting in an evaporator over-pressure condition. Whatever the cause, evaporator over-pressure conditions, if allowed to persist, can ultimately cause damage to the evaporator.

Evaporators in conventional refrigeration systems are often provided with a relief valve that will vent refrigerant vapor to the atmosphere in response to the detection of an evaporator over-pressure situation. In many systems the relief means is a rupture disk designed to fracture at a specified pressure. Fracturing of the disk opens the evaporator to the atmosphere. While the venting of vapor to the atmosphere is an effective way to quickly reduce internal evaporator pressure, the vented refrigerant vapor is not recoverable, and replacement refrigerant must be added to the system after the over-pressure condition is stabilized. Refrigerant is an expensive commodity and in large systems several thousands of pounds can be lost from a system due to rupture disk venting. More importantly, many commonly used refrigerants have been shown to have an adverse effect on the environment when lost to the atmosphere. Finally, since refrigerant vapor is heavier than air and replaces oxygen in an enclosed space, the atmospheric venting of refrigerant in an enclosed space can result in injury or death to persons or animals occupying the space.

U.S. Pat. No. 4,332,136 discloses a refrigeration system that includes a buffer tank for receiving a limited amount of refrigerant vapor from an evaporator vapor chamber. While the pressure relief system disclosed by the '136 patent does not vent vapor to the atmosphere, the '136 system is designed only to provide a brief pressure decrease in an evaporator vapor chamber during loading peaks. The '136 system does not provide for non-atmospheric venting of evaporator over-pressure in system failure conditions, and, in fact, requires normal evaporator operation in order to accomplish its pressure buffering function.

It is an objective of the present invention to adequately deal with system threatening over-pressure conditions in the evaporator portion of refrigeration systems without releasing refrigerant vapor to the atmosphere.

It is another object of the present invention to provide for the unattended, safe removal of refrigerant from a refrigeration system in response to an evaporator over-pressure condition.

It is a further object of the present invention to provide for the automatic, unattended, de-energization of a refrigeration system in response to a detected evaporator over-pressure condition.

It is a feature of the present invention to provide a vessel for selectively storing liquid refrigerant vented from the evaporator component of a refrigeration system in response to a detected evaporator over-pressure condition.

It is a further feature of the present invention to provide a control system for automatically controlling valves for venting liquid refrigerant from the evaporator component of a refrigeration system in response to an over-pressure condition in the evaporator component of the system, and for selectively returning the vented liquid from the storage vessel to the refrigeration system after the over-pressure condition has been rectified.

SUMMARY OF THE INVENTION

The problems outlined above are in large measure solved by the method and apparatus for non-atmospheric venting of evaporator over-pressure in a refrigeration system in accordance with the present invention. Evaporator over-pressure is detected by the system in accordance with the invention, and action is automatically initiated to relieve the pressure before it reaches a point where emergency venting to the atmosphere is required. The method and apparatus hereof provides for the systematic shutdown of a refrigeration system in response to detected evaporator over-pressure conditions, and for the safe and environmentally responsible venting of refrigerant from the refrigeration system.

The over-pressure control apparatus for non-atmospheric venting of evaporator over-pressure conditions in accordance with the present invention broadly includes an evaporator pressure sensor, a storage vessel for receiving liquid refrigerant from the evaporator, and a controller responsive to the pressure sensor. A temperature sensor could be placed in either the refrigerant or in the evaporator water circuit as an alternative to placing a pressure sensor in the evaporator, because of the direct correlation between refrigerant temperature or evaporator water temperature, and evaporator pressure. The controller acts in response to the reading of the pressure sensor or temperature sensor to selectively open and close a pair of control valves coupling the storage vessel to the evaporator of the refrigeration system.

The method for controlling evaporator over-pressure hereof acts to vent liquid refrigerant from the evaporator at a predetermined pressure above normal operating pressure, but below the pressure where emergency venting of refrigerant vapor from the evaporator to the atmosphere is required. The liquid refrigerant vented from the evaporator can be returned from the storage vessel to the chiller system after the evaporator is restored to normal operating pressure.

DETAILED DESCRIPTION OF THE DRAWINGS

Figure 1:
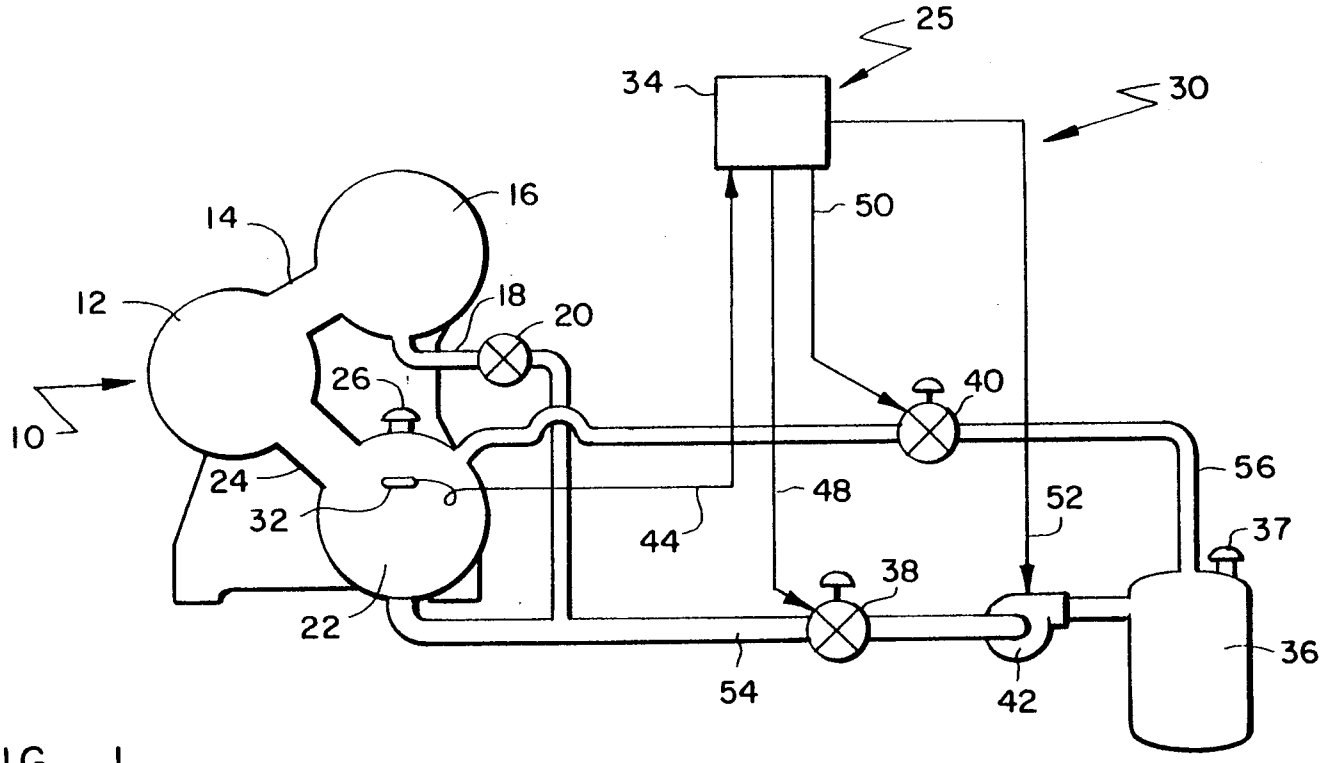
FIG. 1 is a schematic depiction of a refrigeration system including an apparatus for non-atmospheric venting of evaporator over-pressure conditions in accordance with the present invention.

Referring to FIG. 1, a typical refrigeration system 10 generally includes a compressor 12 for compressing vaporized refrigerant, and a hot gas line 14 for conveying the compressed refrigerant vapor to a condenser 16. The compressed refrigerant vapor is condensed into a liquid in the condenser 16 by heat exchange with a cooling medium such as ambient air or water in a cooling tower. The liquid refrigerant is conveyed from the condenser 16 by a refrigerant line 18 to an expansion or metering device 20. The pressure of the refrigerant is reduced as it passes through the expansion device 20, with a resultant decrease of the vaporization temperature of the liquid refrigerant.

The low pressure liquid refrigerant is conveyed from the expansion device 20 to evaporator 22. The refrigerant vaporizes into a gas in the evaporator 22 as it absorbs heat from a medium to be cooled such as air or water. The expansion device 20 maintains the high side pressure created by the compressor 12 and controls the flow of refrigerant to the evaporator 22. A suction line 24 conveys the vaporized refrigerant from the evaporator 22 back to the compressor 12, where the above described cycle begins again.

Operation of refrigeration system 10 is controlled by control panel 25. In addition to the functions described below regarding venting of the evaporator 22, the control panel provides for control of actuation and monitoring functions associated with the normal operation of refrigeration system 10.

Atmospheric relief valve 26 is provided on evaporator 22. Relief valve 26 can be a simple mechanical device that, at a predetermined evaporator pressure, opens to vent refrigeration vapor to the atmosphere. As pressure in evaporator 22 drops below the predetermined pressure, such a relief valve will reset to the closed position. An alternative, more common form of relief valve 26 is the simple rupture disk. A rupture disk is a frangible disk of known properties that ruptures at a certain pressure differential between the inside of evaporator 22 and the atmosphere. By their very nature, rupture disks are not resettable. All refrigerant within the evaporator 22 will accordingly vent to the atmosphere when the disk ruptures.

The over-pressure control apparatus 30 for non-atmospheric venting of evaporator over-pressure conditions in accordance with the present invention broadly includes evaporator pressure sensor 32, controller 34, storage vessel 36, vent valves 38, 40, and optional pump 42.

The sensing probe of pressure sensor 32 is located such that it reads pressure inside evaporator 22. The pressure sensor 32 is in communication with controller 34 via data line 44. Data line 44 may be a wire or fiberotic cord or the like. Pressure sensor 32 can advantageously comprise a commonly available trigger type sensing device having contact closure at a certain set pressure.

The controller 34 for over-pressure control apparatus 30 may be advantageously located within refrigeration system control panel 25. The controller 34 receives inputs, performs simple logic functions and sends command signals to connected devices. Controller 34 is connected to pressure sensor 32 via data line 44, to vent valves 38, 40 via data lines 48, 50 and, when included in the system, to pump 42 via data line 52.

Storage tank 36 is a sealed vessel with two associated pipelines. The input pipeline 54 provides for transfer of liquid refrigerant from evaporator 22 to storage tank 36. The outlet pipeline 56 provides for vapor communication between the vapor side of evaporator 22 and the tank 36. Storage tank 36 is preferably located lower than the evaporator 22 to facilitate the gravity flow of liquid refrigerant from evaporator 22 to storage tank 36. Storage tank 36 is preferably located in an area that is generally no warmer than ambient temperature. Storage tank 36 is large enough to receive the entire liquid refrigerant charge of refrigeration system 10. The tank 36 should be provided with a pressure relief mechanism 37 such as a rupture disk similar to relief valve 26.

Vent valve 38 is carried along pipeline 54 to selectively control fluid communication between the liquid side of evaporator 22 and storage tank 36. The opening and closing of vent valve 38 is under the control of controller 34 via data line 48. The structure of vent valve 38 can advantageously comprise a known butterfly-type valve.

Vent valve 40 is carried along pipeline 56 to selectively control vapor communication between the vapor side of evaporator 22 and storage tank 36. The opening and closing of vent valve 40 is under the control of controller 34 via data line 50. Vent valve 40 is advantageously a solenoid type valve obtainable from any number of manufacturers such as the Sporlan Company of St. Louis, Mo.

In operation, the pressure sensor 32 will, under normal operating conditions indicate normal operating pressure within evaporator 22, and the over-pressure control system 30 will not be activated. Vent valve 38 and vent valve 40 will accordingly be maintained in the closed position, isolating the storage tank 36 from the evaporator 22.

As described above, the atmospheric relief valve 26 associated with the evaporator 22 is designed to open at a predetermined pressure corresponding to an emergency over-pressure condition in evaporator 22. Over-pressure system pressure sensor 32 is set to provide an over-pressure signal to controller 34 at an evaporator pressure that is less than the emergency over-pressure limit. Controller 34 responds to the over-pressure signal by placing the storage vessel 36 in fluid communication with the evaporator 22 to relieve the over-pressure condition, before the emergency over-pressure condition is reached.

In particular, controller 34 sends commands to liquid discharge valve 38 and vent valve 40 to open the valves 38, 40. The liquid side of evaporator 22 is accordingly placed into fluid communication with storage tank 36 through open vent valve 38 and pipeline 54. Pressure in storage tank 36 is equalized with the pressure in evaporator 22 through pipeline 56 and open vent valve 40. Liquid refrigerant accordingly flows from the lowest point of evaporator 22 to storage tank 36 under a gravity drain.

As will be appreciated by those skilled in the art, condenser 16 is generally oriented above evaporator 22. Liquid refrigerant in condenser 16 will accordingly also drain through refrigerant line 18. In systems where the relative orientation of condenser 16, evaporator 22 and storage tank 36 prohibits gravity feed to storage tank 36, pump 42 will be included in the system to pump the liquid refrigerant into storage tank 36.

Controller 34 will send a command to control panel 24 preventing operation of the refrigeration system 10 simultaneously with the placing of the evaporator 22 into fluid communication with tank 36. The controller 34 will also preferably send a signal shutting down a chilled water system associated with refrigeration system 10 for circulating water through the evaporator 22. The control logic will prevent any further operation of the chiller system until the overpressurization condition is corrected via a manual lockout circuit.

Liquid refrigerant stored within tank 36 can be returned to the evaporator after maintenance is performed on the refrigeration system 10. Once the refrigeration system 10 is in condition for a restart, the controller 34 is used to again isolate the storage vessel 36 from the chiller 10 by closing the valves 38, 40.

Although the present invention is described in connection with the preferred embodiment above, it is apparent that many alterations and modifications are possible without departing from the present invention. It is intended that all such alterations and modifications be considered within the scope and spirit of the invention as defined in the following claims.

What is claimed and desired to be secured by Letters Patent of the United States is:

1. An evaporator over-pressure control apparatus for use in conjunction with a refrigeration system, the refrigeration system including an evaporator wherein liquid refrigerant is evaporated to refrigerant vapor at an evaporator normal operating pressure, a compressor for pressurizing the refrigerant vapor, a condenser for condensing pressurized refrigerant vapor to liquid refrigerant and an expansion valve interposed between the condenser and the evaporator for reducing the pressure of the liquid refrigerant, the over-pressure control apparatus comprising:

(a) sensor means for sensing a system condition and providing a signal representative of the evaporator pressure;

(b) controller means operably coupled to the sensor means for providing an actuation signal when the signal provided to the controller means by the sensor means signals a vent pressure greater than the normal operating pressure of the evaporator;

(c) storage means operably coupled to the evaporator for selectively receiving liquid refrigerant from the evaporator; and (d) valve means operably coupled to the controller means and the storage means for selectively venting liquid refrigerant from the evaporator to the storage means in response to the actuation signal, whereby liquid refrigerant is vented from the evaporator to the storage vessel when the evaporator pressure reaches said vent pressure.

2. The invention as claimed in claim 1, including a relief valve operably coupled to the evaporator for selectively venting refrigerant vapor from the evaporator to the atmosphere when the pressure within the evaporator reaches a predetermined emergency pressure, said vent pressure being greater than said normal operating pressure and less than said emergency pressure.

3. The invention as claimed in claim 2, said relief valve comprising a rupture disk designed to rupture at a predetermined rupture pressure, said emergency pressure being equal to said rupture pressure.

4. The invention as claimed in claim 1, said storage means including tank means for storing said liquid refrigerant and conduit means operably extending between said evaporator and said tank means for providing fluid communication between said evaporator and said tank means.

5. The invention as claimed in claim 4, said evaporator including a liquid portion and a vapor portion, said conduit means including a liquid communicating conduit member operably extending between said liquid portion and said tank means.

6. The invention as claimed in claim 5, said tank means including pressure equalization means for selectively generally equalizing the pressure within said tank means with said evaporator pressure.

7. The invention as claimed in 6, said conduit means further including a vapor communicating conduit operably extending between said vapor portion and said tank means, said vapor communicating conduit comprising said pressure equalization means.

8. The invention as claimed in claim 1, said storage means being oriented at a lower elevation than said evaporator whereby said liquid refrigerant is selectively vented to said storage means by gravity drain.

9. The invention as claimed in claim 1, including pump means operably coupled to said evaporator and said storage means for selectively pumping said liquid refrigerant between said evaporator and said storage means.

10. The invention as claimed in claim 1, said sensor means comprising a pressure sensor for providing a pressure signal representative of evaporator pressure.

11. A method for controlling evaporator over-pressure in a refrigeration system, the refrigeration system including an evaporator wherein liquid refrigerant is evaporated to refrigerant vapor at an evaporator normal operating pressure, a compressor for pressurizing the refrigerant vapor, a condenser for condensing pressurized refrigerant vapor to liquid refrigerant and an expansion valve interposed between the condenser and the evaporator for reducing the pressure of the liquid refrigerant, including the steps of:

(a) sensing a condition within the system and providing a signal representative of the evaporator pressure;

(b) comparing the signal to a predetermined setting representative of a vent pressure greater than the normal operating pressure, and providing an actuation signal when the vent pressure is reached;

(c) providing a storage means for selectively receiving liquid refrigerant from the evaporator; and (d) selectively venting liquid refrigerant from the evaporator to the storage means in response to the actuation signal whereby liquid refrigerant is vented from the evaporator to the storage vessel when the evaporator pressure reaches said vent pressure.

12. The method as claimed in claim 11, said evaporator including a relief valve for selectively venting refrigerant vapor from the evaporator to the atmosphere when the pressure within the evaporator reaches a predetermined emergency pressure, said vent pressure being greater than said normal operating pressure and less than said emergency pressure whereby said liquid refrigerant is vented from said evaporator before said emergency pressure is reached.

13. The method as claimed in claim 12, including the step of selectively generally equalizing the pressure within said storage means with said evaporator pressure, thereby facilitating the flow of liquid refrigerant from said evaporator to said storage means.

14. The method as claimed in claim 11, including the steps of restoring the evaporator to normal operating conditions and returning the liquid refrigerant stored in the storage means to the evaporator.

15. The method as claimed in claim 11, said step of sensing a condition within the system comprising the step of sensing the pressure in the evaporator with a pressure sensor operably placed within the evaporator.

* * * * *